US005806698A

United States Patent [19]

Aguirrezabal

[11] Patent Number: 5,806,698

[45] Date of Patent: Sep. 15, 1998

[54] ASSEMBLY DEVICE FOR HINGE-CAPS WITH FINGER COT, ON CONTAINER TUBES PROVIDED WITH PRINTING

[75] Inventor: Antonio Aguirrezabal, Vitoria, Spain

[73] Assignee: Tuboplast Hispana, S.A., Vitoria, Spain

[21] Appl. No.: 865,065

[22] Filed: May 29, 1997

[30] Foreign Application Priority Data

Jun. 10, 1996 [ES] Spain ..... 9601287
Feb. 10, 1997 [ES] Spain ..... 9700258

[51] Int. Cl.[6] ..... B65D 41/04

[52] U.S. Cl. ..... 215/235; 215/330; 215/263

[58] Field of Search ..... 215/235, 237, 215/43, 44, 263, 330, 331, 329, 216

[56] References Cited

U.S. PATENT DOCUMENTS 5,096,077 3/1992 Odet et al. ..... 215/263 X
5,143,234 9/1992 Lohrman et al. ..... 215/331 X
5,145,080 9/1992 Imbery, Jr. ..... 215/330 X
5,160,057 11/1992 Fitjer ..... 215/331 X
5,205,424 4/1993 Gaspar ..... 215/330 X
5,560,505 10/1996 Schneider et al. ..... 215/330
5,690,241 11/1997 Montgomery ..... 215/330 X

FOREIGN PATENT DOCUMENTS 2044736 10/1980 United Kingdom ..... 215/330

*Primary Examiner*—Allan N. Shoap
*Assistant Examiner*—Nathan Newhouse
*Attorney, Agent, or Firm*—Browdy and Neimark

[57] ABSTRACT

A device according to which the closing or plugging operation of tubes with a finger cot (11) area of the cap (2, 3) centered with the main printing on the tube (1), is carried out thanks to the combination of a latch (7) on the tube and a stop catch (10) on the cap, with the latter being in the shape of a transversal U-shaped cross-section with unequal arm. Having duly referenced both the latch and the stop catch, turning of the cap causes the final locking of the latch in the interior of the stop catch, without any additional complements.

5 Claims, 3 Drawing Sheets

ASSEMBLY DEVICE FOR HINGE-CAPS WITH FINGER COT, ON CONTAINER TUBES PROVIDED WITH PRINTING

The invention relates to an assembly device for hinge-caps with finger cot, on container tubes provided with printing, particularly suitable for carrying out the exact positioning of caps on container tubes, when the latter are provided with graphic printing and the former are of the type that have two portion connected by a hinge, and are provided with a recess or cavity for the user's finger to open the upper part of the cap.

In units of this kind, the normally accepted manufacturing process begins with a first step in which the extrusion of the tube is carried out by using the appropriate machines, followed by the injection of the head of the said tube, while the cap is made separately.

In a second operation also using specific installations, the tube is printed and then varnished.

Finally, the assembly of the cap onto the neck of the tube is carried out, so that the finger cot area of the cap is centred in relation to the printing on the tube.

This final operation is carried out using specific arrangements in conventional facilities in order to achieve the previously mentioned centring, which entails technical difficulties which are removed from the classic screwing of the cap onto the tube, bringing as a result a relatively low production performance that causes high production costs.

On the other hand, the cap-fitting machines used in this technique are usually not high precision mechanisms, which means that the stress exerted on the cap cannot be controlled to the degree which would be desirable. Moreover, as the component items are of the plastic type, tube and cap, and logically flexible, it is not possible to achieve the exactitude and precision in assembly that could be achieved if these said components were made of steel, for example.

One object of the invention is to provide a device for the assembly of the cap onto the neck of the tube in tubes provided with printing centred with the finger cot in the cap, that uses conventional machines and installations, providing an assembly whose production performance is not limited.

Another object of the invention is an assembly arrangement that provides an assembly of the cap with a normal closing stress and, nevertheless, requires the application of a high stress for its possible dismantling.

Another object of the invention is an assembly arrangement that does not make the final assembly, in practice, more costly.

Another object of the invention is the fact of providing a stop that acts as a retainer during the screwing on of the cap, preserving the integrity of the assembly and providing greater security.

Another object of the invention is to facilitate and make the entry of the cap onto the neck of the tube smoother, easier and more convenient.

Another final objective of the invention is to maintain the perfect alignment of the screw-threaded neck of the tube in relation to the tube itself, so that when the cap is situated, it is, in turn, perfectly concentric with the tube.

In order to put these objectives into practice, the invention starts with a tube provided with a head with a hinged cap whose lower portion is provided with a inner screw-threaded neck that corresponds with the neck of the tube.

The main printing on the tube is carried out with reference to a protruding latch on the trunco-conical portion of its head, which adopts a radial position in relation to the centre of the tube and is established in a parallel direction to the longitudinal axis of the said tube.

The latch in question is made in a position such that it acts as a reference in order to carry out the printing on the tube and, at the same time, it is a reference for the start of the screw thread on the neck of the said tube, rising a certain distance and being interrupted below the said screw thread.

On its part, the cap is provided internally with a stop catch that starts from its base in a parallel direction to its longitudinal axis. The transversal cross-section of this stop catch is U-shaped and one of its arms or wings is connected to the inner neck of the cap, while the other arm is slightly shorter that the first, procuring a space or gap as regards the said neck, with this shorter arm being placed in a clockwise position in relation to the longer arm.

The stop catch occupies a radial position in relation to the longitudinal axis of the cap and its length, vertically, remains between that of the screw-threaded internal neck and that of the outer skirt of the said cap.

The portion of the stop catch in the cap is referenced in relation to the start of the screw thread and also in relation to the position of the finger cot to open the upper hinged portion of the cap.

In the operation to assemble the cap onto the tube, once the tube has been printed and varnished, the way of proceeding is identical to that of a conventional assembly. Thus, the cap is situated onto the screw-threaded neck of the tube, so that the internal screw-threaded projection in the cap fits onto the said neck and turning of the cap starts.

As the screwing together operation takes place, the moment arrives when the short arm or wing of the stop catch in the cap makes contact with the latch on the tube and at this moment the stop catch flexes in such a way that it passes the position of the said latch, allowing the latch to become locked in the interior of the U shape that the stop catch forms, so that if an attempt is made to continue the screwing together, this is prevented by the contact between the latch and the longer arm of the stop catch.

When this takes place, the edge of the outer skirt of the cap has made contact with the trunco-conical head of the tube, so the assembly has been completed. Moreover, as already pointed out previously, as the printing on the tube is referenced with the latch and the stop catch referenced with the position of the finger cot, respectively, the position of the finger cot can very easily be made to coincide with the main printing on the tube.

In order to carry out the screwing operation, as can be tested, it is sufficient to exert a normal stress on the cap until the latch becomes locked inside the stop catch. This screwing operation, on the other hand, is stable, given that in order to unscrew the cap it is necessary, on the contrary, to overcome the shorter arm of the stop catch, for which it is necessary to apply a dismantling stress of between 11 and 13 kilograms per square centimetre on the cap, which is sufficiently wide to provide total security as regards the disassembly of the cap.

As will be appreciated later in relation with the accompanying drawings, the outer end of the shorter arm of the stop catch is conveniently rounded, in correspondence with another possible rounding of the anticlockwise side of the latch. in this way, flexing of the stop catch during the screwing operation is made easier.

On the contrary, the internal faces of the stop catch and the clockwise side of the latch are straight surface that correspond with each other.

With the system that the invention presents, the cap-fitting can be carried out with a completely standard machine, without additional complements and with a rate of assembly identical to that of tubes and conventional caps.

However, on some occasions the screwing stress reaches such a point that the stop catch puts pressure on the latch and finally forces it, ruining the assembly.

On the other hand, the effect of the shorter arm of the stop catch on the latch at the start of the cap-fitting operation is carried out with a certain abruptness, due to the shape of the transversal section of the said latch.

As indicate previously, as regards conventional cap-fitting machines, there could be the risks of the stop catch going beyond the position of the latch.

To avoid these disadvantages, we point out the fact that at the end of the clockwise face of the latch, a chamfer or bevel is made, on which the end of the short arm of the stop catch makes contact. This contact makes the said end is raised immediately after the cap-fitting machine has made the cap turn in order to establish contact of the stop catch with the latch in a gentle movement that totally preserves the integrity of both items.

On the other hand, a certain distance from the latch in a clockwise direction, the trunco-conical portion of the tube has another vertical projection parallel to the latch itself, which has a wide vertical wall on the side towards the latch. The height of this projection is similar to the height of the latch and its length, i.e. the distance to its end in relation to the centre of the tube, is substantially greater.

In the presence of a possible overpressure at the cap-fitting machine, the cap is controlled in turning by the latch itself, which offers resistance to the longer arm of the stop catch in the cap but, in the present case, the vertical projection on the tube also acts as a wall against the possible turning of the cap, as it makes contact in the same way with the shorter arm of the stop catch.

In this way, safety and efficiency are achieved in cap-fitting, with the latch always being kept inside the U shape of the stop catch and the shorter arm of the stop catch between the latch and the vertical projection.

It has been demonstrated by experiments carried out that whatever the turning pressure exerted on the cap by the cap-fitting machine, the control of this turning was always carried out, with no cases of spoilage of the assembly having occurred.

Obviously, this is achieved in all those cases where the vertical position of the finger cot in the cap coincides always with the centre of the main printing on the tube.

On occasions, it happens that as a result of the existence of the latch and of the vertical projection on the tube, once that the injection process has been carried out on the corresponding machine and while it is cooling, the mass of the said latch and vertical projection causes a pull on the neck of the tube towards their position, which produces a slight inclination of the neck in relation to the axis of the tube. Therefore, when the cap is later situated on the said neck, the cap is inclined in relation to the tube.

To solve this possible inconvenience, two small projections are made, starting from the conical portion of the tube and close to the start of the screw-threaded neck, located in a position approximately diametrically opposite the previously mentioned latch and vertical projection. These two projections have a mass approximately equal to the mass of the said latch and vertical projection, so that during cooling, they cause a pull on the screw-threaded neck of the tube which is opposite to the pull mentioned previously, with which the screw-threaded neck of the tube always remains unalterable in its correct position.

All these and other details of the invention will be understood with greater clarity with reference to the accompanying sheets of drawings, in which the following are represented, with a non-restrictive nature:

Figure 1:
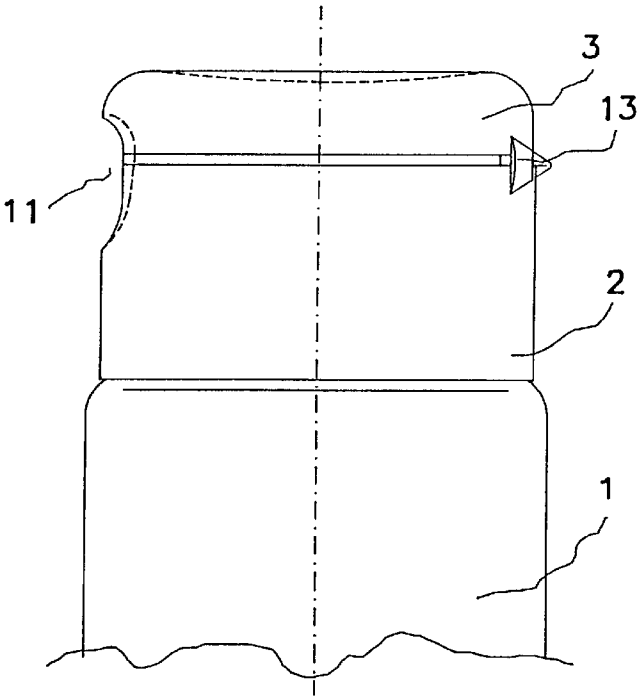
FIG. 1 is a general elevation of the upper part of container tube provided with a hinged cap.

With reference now to FIG. 1, we can see the container tube (1), whose upper part is occupied by the cap with its two hinged portions (2, 3) connected by the hinge (13), also showing the finger cot (11) for opening the upper part (3). It is this finger cot that must be centred vertically with the printing on the front of the tube (1).

Figure 2:
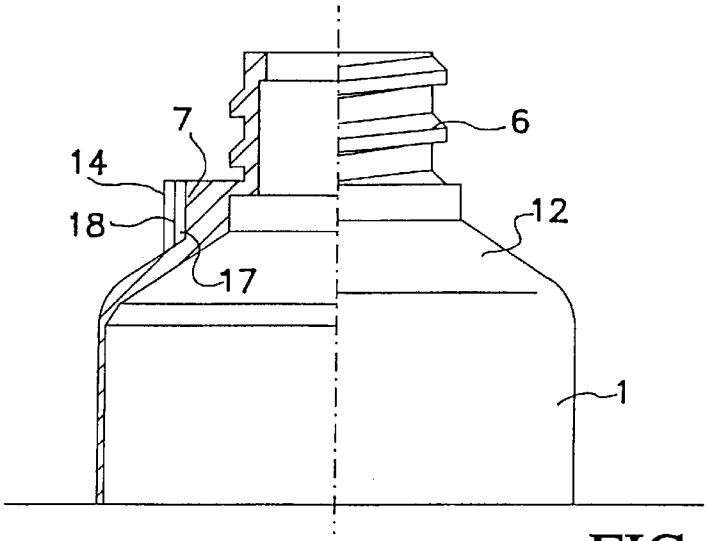
FIG. 2 shows a cross-sectional elevation of a tube in accordance with the invention, corresponding to the line I—I in FIG. 3.

As regards FIG. 2, we can appreciate the container tube (1) for the product, its trunco-conical upper end (12) for closure and the screw-threaded neck (6). Starting from the trunco-conical surface (12) and of the same height are the latch (7) and the projection (14). The face or wall (18) of the projection (14) that controls the turning of the cap and the stop catch, and the end chamfer (17) on the latch can also be observed.

Figure 3:
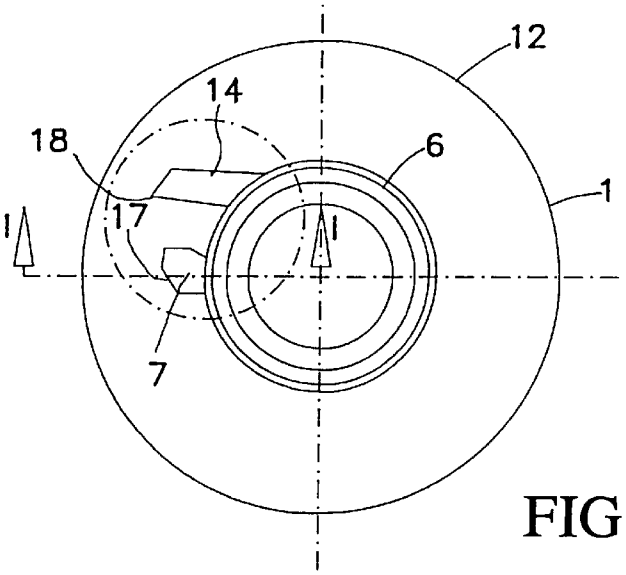
FIG. 3 represents the top view of the tube in accordance with the invention

The arrangement or positioning of these two items is perfectly defined in FIG. 3, in which it also become clear how the projection (14) is longer than the latch (7), i.e. it protrudes further than the latch from the centre of the tube.

Figure 4:
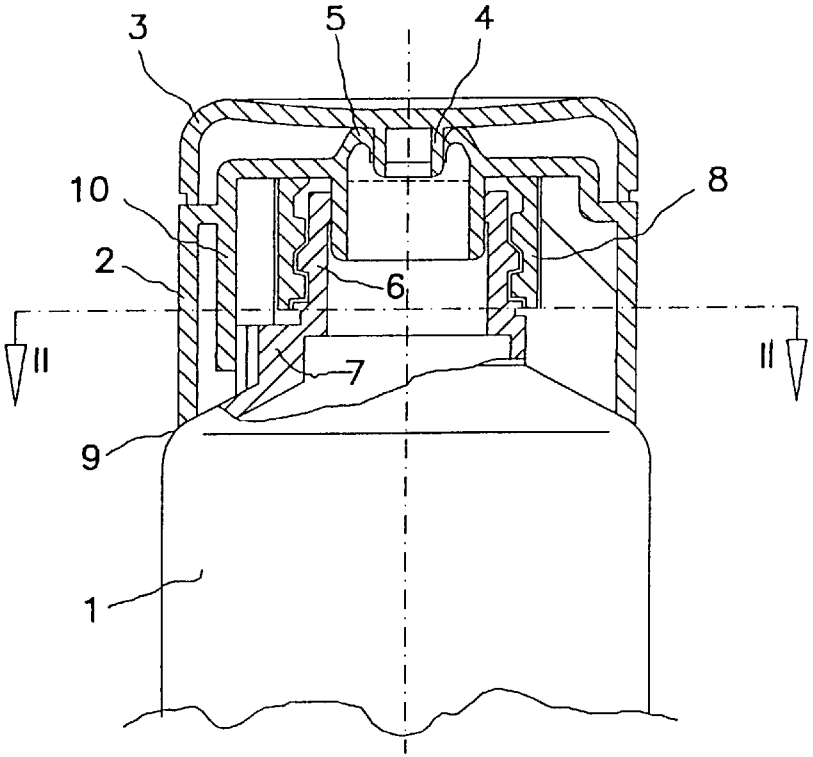
FIG. 4 is a cross-sectional elevation of the tube with the cap assembled, in accordance with the invention, on the line III—III in FIG. 5.

As regards FIG. 4, we can see the cap assembled onto the tube, with this cap consisting of the lower portion (2) and the upper portion (3) hinged together at (13). The cap has an inner neck (8), by means of which it is connected with the screw-threaded neck (6) of the tube (1), being provided with a central cylindrical area (5) that extends towards the interior of the neck, which opens or closes by means of the operation of the projection (4) in the upper portion (3) of the cap, when this is open or closed, respectively, over the lower part (2) of the cap. The cap rests on the portion (12) of the tube by means of the end (9) of the lower portion (2).

To carry out opening, the finger cot (11) can be seen, by means of which the user can insert a finger; this finger cot must be vertical and centred with the printing on the front of the tube.

Figure 5:
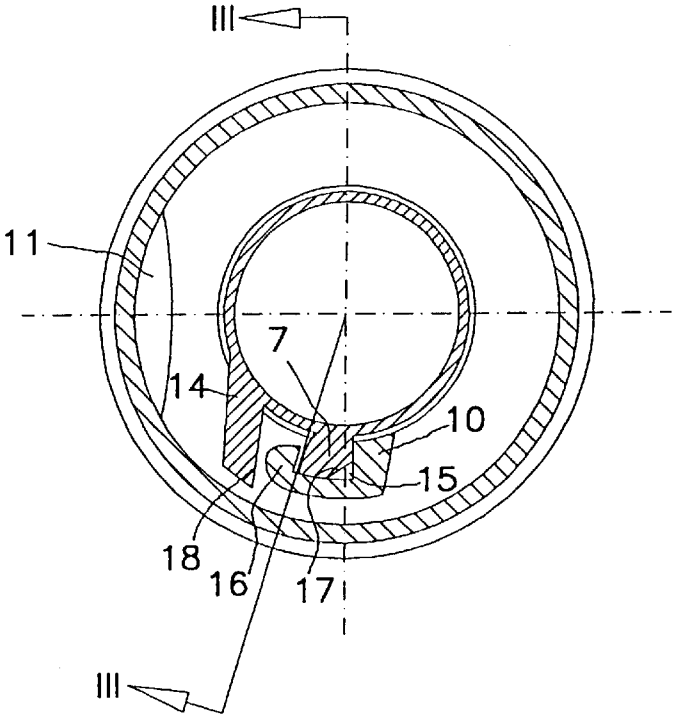
FIG. 5 is the result of the cross-section indicated by line II—II in FIG. 4.

According to FIG. 5, we can observe the assembly or cap-fitting already performed, with the latch (7) received in the hollow space (15) procured in the stop catch (10). The end (16) of the shorter arm of the stop catch (10) is normally rounded, so that the contact on the chamfer (15) of the latch (7) before the position showed in this FIG. 5, helps it to overcome this obstacle.

Once it is in the position shown in FIG. 5, it can be appreciated how on trying to turn the cap, the stop catch (10) meets the impediment of the latch (7) and of the wide wall (18) of the projection (14), which perfectly control the immobility of the positioning, exactly as illustrated in this FIG. 5.

Figure 7:
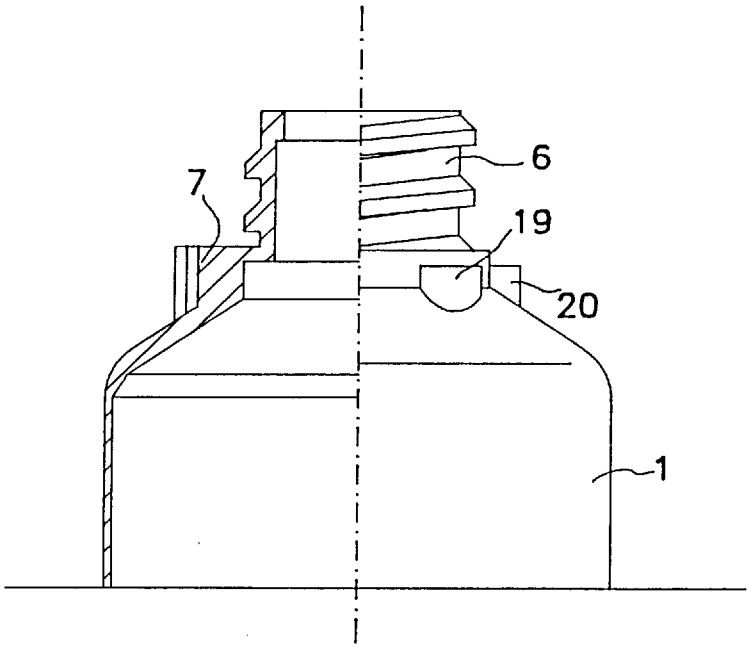
FIG. 7 is a side view of the above, also showing the cross-section along the line IV—IV in FIG. 6.
Figure 6:
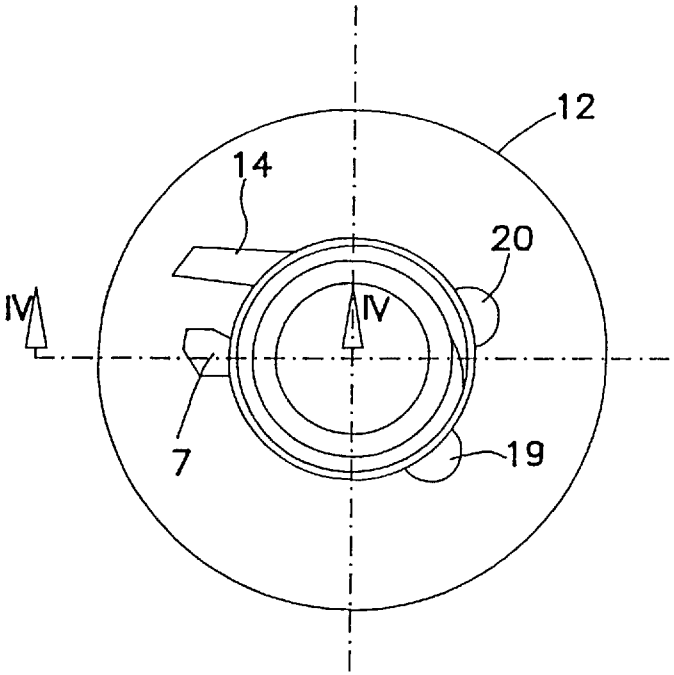
FIG. 6 shows a top view of the tube in which the two projections diametrically opposed to the latch and vertical projection can be seen.

With regard to FIGS. 6 and 7, it is again possible to appreciate the tube (1) with a screw-threaded neck (6) as well as the latch (7) and the vertical projection (14). In positions which are approximately diametrically opposite the latch and vertical projection, we can observe the two projections (19, 20), which have a mass approximately equal to the sum of the masses of the latch and vertical projection.

As mentioned previously, the possible pull of the masses of the latch (7) and the vertical projection (14) on the neck during cooling after injection, would thus be perfectly compensated by the pull of the masses of the two projections (19, 20) on the said neck, with full guarantees that the neck should always remain in the correct position, with its axis aligned with the axis of the tube (1).

Moreover, it is pointed out, for the appropriate purposes, that the existence of these projections (19, 20) is studied so that it does not hinder the turning of the stop catch (10) in the cap.

It is important to point out, once having described the nature and advantages of this invention, its non-restrictive character, inasmuch as changes in the shape, materials or dimensions of its constituent parts will not in any way alter its essence, as long as they do not mean a substantial variation of the whole assembly.

I claim:

1. Assembly device for hinge-caps wherein the caps are screwed in a clockwise direction to secure the caps in place on container tubes provided with printing, a tube (1) provided with printing and with a screw-threaded neck (6), and a hinge-type cap or lid with a lower portion (2) with an outer skirt (9) and an internally screw-threaded neck (8) that corresponds with the neck of the tube, and another upper portion (3) hinged (13) to the previously-mentioned lower portion, which, on being operated, opens or closes a hole in the said portion, which has a recess in the form of a finger cot (11) to operate the upper portion, which is characterized in that the head of the tube is provided with a protruding latch (7) that extends in a parallel radial direction in relation to the longitudinal axis of the tube, with the said latch being of an approximately rectangular transversal cross-section with reference to the printing on the tube and with the start of the screw thread, while the cap (2, 3) is provided with a protruding internal stop catch (10) that starts from its base and from its screw-threaded neck and that extends in a parallel radial direction in relation to the longitudinal axis of the cap, remaining a certain distance from the outer skirt (9) and having a transversal U-shaped cross-section with unequal arms or wings, of which a shorter arm (16) is on the more clockwise positioned side and procures a central open space or gap (15) towards the neck (8), in that this referred stop catch is located in relation to the start of the screw thread and to the position of the finger cot, in that the shorter arm of the stop catch flexes on contact with the latch when the cap is turned, until the latch (7) becomes locked in the interior (15) of the stop catch (10), with the latch having an end chamfer or bevel (17) on a counterclockwise vertical side, on which the shorter arm or wing (16) of the stop catch (10) makes contact, and in that in a clockwise direction with respect to the latch (7) a vertical projection (14) of a similar height to the latch and longer than it protrudes out from the tube, with this projection having a wide flat vertical wall (18) carried out in a counter clockwise direction, which delimits, by acting as a stop, the possible turning of the stop catch in the cap in the positioning of the said cap in a cap-fitting machine.

2. The assembly device in accordance with claim 1, characterized in that in the space or gap between the vertical wall (18) of the vertical projection (14) in the cap and the clockwise side of the latch (7), the shorter arm or wing (16) of the said stop catch becomes lodged and controlled, once it has been assembled.

3. The assembly device in accordance with claim 1, characterized in that the exterior of the shorter arm or wing (16) of the stop catch, as well as the corner of the anticlockwise side of the latch are rounded in order to facilitate the sliding, when flexed, of the said arm, when the cap is turned.

4. The assembly device in accordance with claim 1, characterized in that the stress needed to force the cap from the tube, by unscrewing, is approximately between 11 and 13 kilograms per square centimetre.

5. The assembly device in accordance with claim 1, characterized in that on the trunco-conical portion (12) of the tube (1) and in positions which are approximately diametrically opposite those of the latch (7) and vertical projection (14) are located another two projections (20, 19), which start from the portion (12) and from the base of the neck (6), whereby the sum of the masses of the two projections is approximately equal to the sum of the masses of the latch (7) and vertical projection (14) and in that the stop catch (10) in the cap turns freely without being hindered by these projections (20, 19).

* * * * *